United States Patent [19]

Gruber

[11] 4,232,829

[45] Nov. 11, 1980

[54] NOZZLE ARRANGEMENT FOR ENCAPSULATING MACHINES

[76] Inventor: Roland F. Gruber, 1, Brusselstraat, B-1744 Sint-Ulriks Kapelle, Belgium

[21] Appl. No.: 944,002

[22] Filed: Sep. 20, 1978

[30] Foreign Application Priority Data

Sep. 21, 1977 [BE] Belgium ..... 858900
Nov. 28, 1977 [BE] Belgium ..... 861262

[51] Int. Cl.[3] ..... B05B 1/00

[52] U.S. Cl. ..... 239/433; 181/252; 181/255; 181/264; 239/590.3; 406/194

[58] Field of Search ..... 406/93, 94, 108, 153, 406/194; 239/589, 590, 590.3, 433, 434.5; 181/211, 230, 247, 252, 255, 256, 258, 265, 267, 269; 222/637

[56] References Cited

U.S. PATENT DOCUMENTS

| | | | |
|---|---|---|---|
| 721,972 | 3/1903 | Siefken | 239/590.3 X |
| 1,644,226 | 10/1927 | Bedard | 239/590.3 X |
| 2,175,160 | 10/1939 | Zobel et al. | 239/589 |
| 2,643,730 | 6/1953 | Beattie | 181/265 |
| 2,667,940 | 2/1954 | Gallihugh | 181/265 |
| 3,009,529 | 11/1961 | Brown | 239/590.3 X |
| 3,159,237 | 12/1964 | Thomas | 181/252 |
| 3,468,397 | 9/1969 | Vegeby | 181/256 X |
| 3,982,605 | 9/1976 | Sneckenberger | 181/247 |
| 4,036,324 | 7/1977 | Washbourne | 181/252 |

FOREIGN PATENT DOCUMENTS

| | | | |
|---|---|---|---|
| 326883 | 10/1920 | Fed. Rep. of Germany | 239/590.3 |
| 2512637 | 10/1975 | Fed. Rep. of Germany | 239/590.3 |
| 105282 | 6/1924 | Switzerland | 239/590.3 |

*Primary Examiner*—James L. Rowland

[57] ABSTRACT

The invention relates to encapsulating machines and more especially to the device for putting the capsules in position in the encapsulation head. It consists in the creation in the air duct for propulsion of the capsules of one or more chambers for successive expansions of the air separated by nozzles the ratio of the bores of which is such that the incomplete expansion of the air is obtained in each intermediate chamber and the expansion is complete at the output in the ambient air. In one embodiment the cross-section of the outlet nozzle appears in the form of a flattened tube and the expansion chamber is filled with an acoustic insulation material. (FIG. 4). In another embodiment, a plurality of channels surround the outlet nozzle which communicate with the atmosphere and thereby introduce air into the outlet nozzle, providing a continuous circulation of air round the device. (FIG. 6).

4 Claims, 8 Drawing Figures

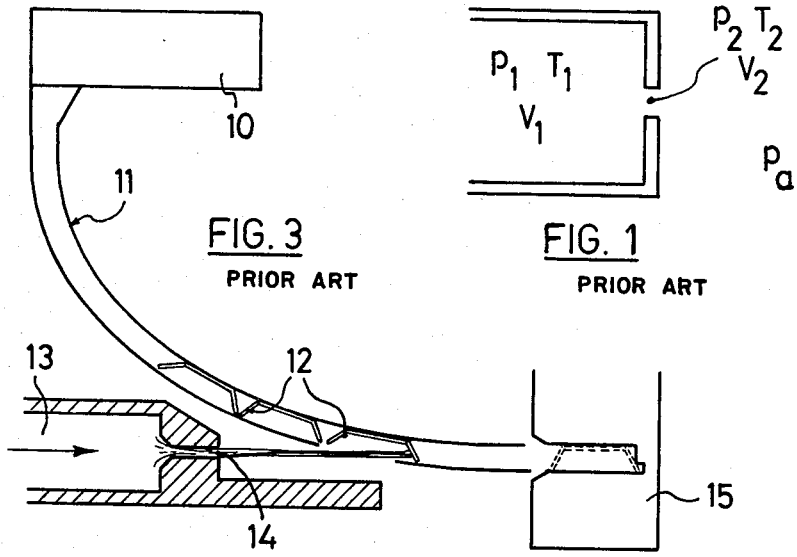
FIG. 3
PRIOR ART
FIG. 1
PRIOR ART
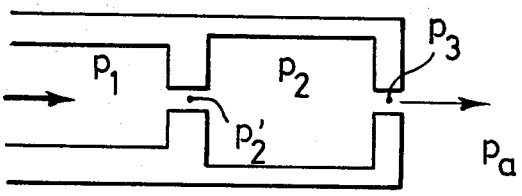
FIG. 2
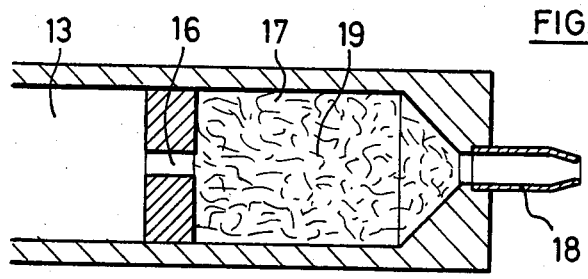
FIG. 4
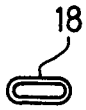
FIG. 4A
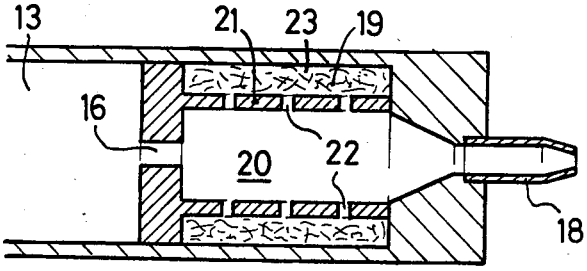
FIG. 5

NOZZLE ARRANGEMENT FOR ENCAPSULATING MACHINES

The present invention refers to improvements applied to encapsulating machines and especially to the device for putting capsules in position in the encapsulation head.

Known encapsulating machines comprise, in general, a capsules distributor from which the capsules are brought one by one by way of a curvilinear path which passes from the vertical to the horizontal and ends at the encapsulation head. At the end of this descending course, the capsules are subjected to a jet of air under pressure in order to propel them into the encapsulation head.

In the existing machines this propulsion is achieved by an air duct under pressure equipped with a nozzle through which the air escapes at high velocity, which causes a disagreeable noise which may reach 120 to 130 dB.

The aim of the present invention is substantially to correct this disadvantage and thus to improve the working conditions of the operators.

Studies which have been carried out on the subject of the causes of this noise have enabled -as is indispensable- the different factors to be determined which are at the source of this noise.

Thus it may be shown theoretically that the mass flow of air passing through this nozzle depends only on the pressure and the specific volume upstream of the nozzle.

It is in fact a matter of an adiabatic expansion of the air and hence the following equations (FIG. 1) may be established in which:

$p_a$=atmospheric pressure
$p_1$=pressure upstream of the nozzle (N/m$^2$)
$p_2$=pressure at the locality of the nozzle
$p_{cr}$=critical pressure
R=specific constant (Nm/kg °K.)
T=temperature (°K.) ($T_1$ upstream, $T_2$ at the nozzle)
V=specific volume (m$^3$/Kg) ($V_1$ upstream, $V_2$ at the nozzle)
v=velocity (m/s)
s=cross-section (m$^2$)
$\rho$=specific weight (Kg/m$^3$)=1/V
M=mass flow kg/s
$\mu$=flow coefficient=$\xi\phi$
$\xi$=contraction coefficient
$\phi$=retardation coefficient (velocity)
F=force or thrust of the air jet.

The pressure in the nozzle $p_2 \leqq p_{cr}$; under adiabatic conditions $p_{cr}=0.528\times p_1$ as shown in greater detail in the book "Les Fondements de la Thermique et de l'Hydraulique" by A. TCHERNOV and N. BESSREBRENNIKOV, published in the Moscow editions.

The velocity in the nozzle $v_2 \leqq v_{cr}$; now under adiabatic conditions $$v_{cr} = 1.08\sqrt{RT_1} = 1.08\sqrt{p_1 v_1}$$

Under these same conditions, the mass flow $$M = s_2\,\mu\sqrt{\frac{2g\,\Delta p}{\rho}}$$

and in particular at the critical pressure $p_2=p_{cr}$, hence $p_2=0.528\ p_1$.

One consequently obtains $$M_{max} = 0.685.\ s_2\sqrt{\frac{p_1}{v_1}}$$

and it can be seen that the mass flow depends only upon the pressure ($p_1$) and the specific volume ($v_1$).

In the case where $$p_1 > \frac{Pa}{0.528}$$

one obtains at the outlet from the nozzle the critical velocity ($v_{cr}$) or the velocity of sound which is one of the causes of the noise.

Another factor causing noise is the incomplete expansion of the air at the locality of the nozzle.

The pressure $p_2$ being still higher than the ambient pressure $p_a$ the air is going to expand abruptly upon contact with the capsule.

The thrust of the air jet or the force exerted on the capsule may be calculated in the following manner:

$$F = \rho\,.s.v^2 = \rho\,.s.v.v = \frac{s.v}{v.g}\,.v$$
$$\text{or } F = \frac{M.v}{g}\ \text{(kg)}.$$

In accordance with the invention this disadvantage is corrected thanks to the creation in the air duct for propulsion of the capsules one or more chambers for successive expansions of the air, separated by nozzles the ratio of the bores of which is such that incomplete expansion of the air is obtained in each intermediate chamber and that the expansion is complete at the output into the ambient air.

In fact with only one supplementary expansion chamber the conditions represented in FIG. 2 are obtained.

The difference in pressure $\Delta_1\,{}^2p$ may be calculated by an equation, the same as $\Delta_2\,{}^3p$.

From third equation $\Delta_1\,{}^3p=\Delta_1\,{}^2p+\Delta_2\,{}^3p$ one can solve this problem with three unknowns and hence find the values of $p_1$, $p_2$, $p_3$.

The bores $s_2$ and $s_3$ must then be chosen so that:

(a) from $p_1$ to $p_2$ the first expansion is incomplete: one obtains:

$$v_{cr} = v_2' = 1.08\sqrt{p_1 v_1}$$
$$p_{cr} = p_2' = 0.528\,p_1$$
$$M = 0.685\,s_2\sqrt{\frac{p_1}{v_1}}$$

and one will have noise in the enclosure $p_2$.

(b) the second expansion is complete, that is to say, the pressure $p_3=p_a$ one will have:

$$v_3 < v_{cr}\,(v_{cr} = 1.08\sqrt{p_2 v_2})$$
$$p_3 < p_{cr}\,(p_{cr} = 0.528\,p_2)$$
$$M = s_3\,\mu\sqrt{\frac{2g\,p_3 - p_a}{\rho}}$$

-continued $$F = M \cdot v_3$$

In the case where the pressure $p_1$ would be too great to obtain complete expansion with a single expansion chamber one may: either add a second expansion chamber or create in the single chamber a load loss by filling it with a material having acoustic insulation properties such, for example, as glass wool.

One improved embodiment of the device described above enables the performance to be substantially improved and the noise proceeding from the capsule propulsion device to be reduced still more.

This improved device is characterized essentially in that the expansion chamber of which the air exhaust nozzle is the continuation is equipped with an air inlet connected to the atmosphere, this air inlet being effected and arranged so that a zone of air at overpressure being created at the outlet from the exhaust nozzle a slight depression is obtained in the expansion chamber owing to the suction produced by the air introduced into the exhaust nozzle and that a continuous circulation of air takes place round the device.

In order to understand the invention better practical embodiments will be described below by referring to the figures in which:

FIG. 1 is a diagram of a nozzle of the prior art showing the location of the various components of the equations established above:

FIG. 2 is a diagram of a nozzle arrangement according to the present invention showing the location of the various components of the equations established above:

FIG. 3 is a diagrammatic section showing the capsule propulsion device in an existing machine;

FIG. 4 is a diagrammatic section of the device which is the object of the invention;

FIG. 4A is a front view of the mouth of the outlet nozzle;

FIG. 5 is a variant embodiment as FIG. 4;

Figure 6:
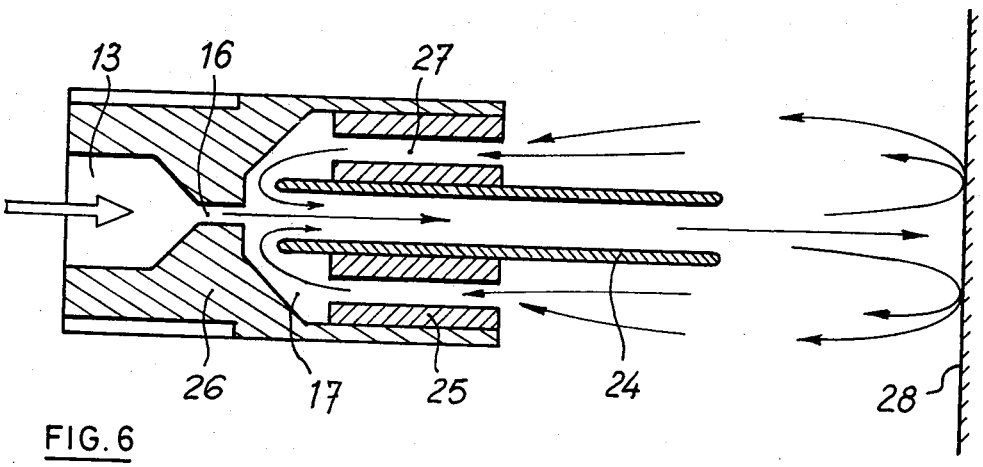
FIG. 6 is a longitudinal section of another variant of the device in accordance with the invention which exhibits an improvement with respect to the device described with reference to FIGS. 3–5.
Figure 7:
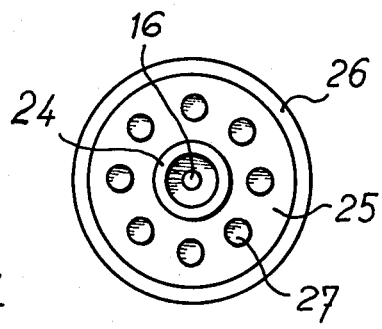
FIG. 7 is a front view of this device.

In FIG. 3 there is shown at 10 the capsule distributor of an encapsulating machine constructed in accordance with existing techniques.

From this distributor 10 the capsules are brought into a curvilinear duct 11 passing from the vertical towards the horizontal. At the end of their descent the capsules 12 are subjected to a jet of air under pressure brought through a duct 13 and passing through a nozzle 14. Under the action of the thrust created by this air jet the capsule 12 is put into position in the encapsulation head 15.

In accordance with the invention and as shown in FIG. 4 this capsule propulsion device has been arranged as follows: the air duct under pressure 13 ends at a first nozzle 16 through which the air enters an expansion chamber 17. This chamber 17 has in turn an outlet to the ambient air by way of a second nozzle 18.

A special characteristic of this outlet nozzle 18 is that its cross-section appears in the form of a flattened tube in order to increase the surface of action on the capsule whereas existing nozzles such as those shown in FIG. 1 have a circular cross-section with a very small diameter.

Advantageously and in order to obtain complete expansion of the air at the outlet 18 the chamber 17 may be filled with an acoustic insulation material, for example, glass wool 19.

Laboratory tests have enabled a gain of 30 dB to be verified as the reduction in the noise proceeding from this device.

Another embodiment is illustrated in FIG. 5.

In this embodiment the air duct under pressure 13 ends at a first nozzle 16 through which the air enters an expansion chamber 20 bounded internally by a tubular part 21 perforated by a series of orifices 22.

These orifices give access to a second peripheral expansion chamber 23 which is filled with an acoustic insulation material 19. This arrangement increases the capacity for expansion of the air thanks to the series of orifices 22.

As is apparent from FIG. 6 of the drawings the improved embodiment of the device for propulsion of the capsules likewise comprises an air duct under pressure 13 ending at a nozzle 16 through which the air enters an expansion chamber 17 which has in turn a tubular part 24 acting as an outlet nozzle.

This tubular part 24 is held on the axis of the first nozzle 16 by a bush 25 integral with the body 26.

In accordance with this embodiment channels or ducts 27 are drilled in the bush 25 and extend in parallel with the nozzle 24.

Operation of the device is as follows:

The compressed air arrives through the duct 13 and passes into the chamber 17 through the nozzle 16, which has the effect of increasing the velocity and reducing the flow of air passing at this point.

The jet of air arriving in the expansion chamber 17 continues its path through the outlet tube 24.

The air lying in the expansion chamber 17 and in the channels 27 is carried along by the air current passing at high velocity and the volume of air leaving through the nozzle 24 is increased; the air leaving the nozzle 24 then comes to a stop against an impact surface 28 which, in this event, is a capsule.

Thus between the outlet nozzle and the nozzle 24 and the impact surface 28 there is formed a zone of air at overpressure whilst in the expansion chamber 17 a slight depression is created due to the suction by the air jet passing through the tube 24.

A continuous circulation of the air round the device is thus created, which tends to improve the performance of the whole further.

The advantages are:

As the volume of air in the nozzle 24 is increased by the contribution of the air coming from the channels 27 the diameter of the first nozzle 16 may be reduced (as far as 50% of its original value) and the consumption of compressed air may be reduced. This reduction may go up to 50%.

Another advantage is that one succeeds in reducing still further the noise proceeding from the propulsion device.

By way of example, under the most unfavorable conditions a noise of 88 dB is obtained, measured at a distance of 1 meter from the device produced in accordance with the invention, connected to a source of compressed air 13 of 4 kg/cm with a first nozzle 16 of diameter 1.4 mm, outlet tube 24 with an internal diameter of 4 mm and eight ducts 25 of diameter 2.5 mm.

Under normal conditions one obtains about 70 dB against 90 dB with the device in accordance with FIGS. 3 to 5 and 120 dB with devices known hitherto.

As in the other embodiment the mouth of the outlet nozzle 24 may be flattened in order to increase the area of action against the capsule.

What I claim is:

1. A device for putting capsules in position in the encapsulation head of an encapsulating machine comprising at least one expansion chamber, inlet means for feeding air under pressure to said expansion chamber and tubular air outlet means, said device being provided with further air inlet means connected to the atmosphere, said further air inlet means being effected and arranged so that a zone of air at overpressure is created at the outlet from the tubular air outlet means, a slight depression is obtained in the expansion chamber owing to the suction produced by the air introduced into said tubular air outlet means and that a continuous circulation of air takes place round the device.

2. A device as in claim 1, wherein said further air inlet means are shaped as channels arranged round said tubular air outlet means and extending substantially parallel with respect to it.

3. A device as in claim 2, wherein said channels are arranged in a bush integral with the device.

4. A device as in claim 1 wherein said tubular air outlet means is coaxial with said first mentioned air inlet means.

* * * * *